US008517574B2

(12) United States Patent
Horng et al.

(10) Patent No.: US 8,517,574 B2
(45) Date of Patent: Aug. 27, 2013

(54) LAMP WITH AIR CHANNEL

(75) Inventors: Alex Horng, Kaohsiung (TW); Ming-Tsung Li, Kaohsiung (TW)

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 568 days.

(21) Appl. No.: 12/770,893

(22) Filed: Apr. 30, 2010

(65) Prior Publication Data

US 2011/0267829 A1 Nov. 3, 2011

(51) Int. Cl.
*F21V 29/00* (2006.01)

(52) U.S. Cl.
USPC ..... 362/373; 362/345

(58) Field of Classification Search
USPC ..... 362/547, 218, 294, 345, 373
See application file for complete search history.

(56) References Cited

U.S. PATENT DOCUMENTS

| | | | | |
|---|---|---|---|---|
| 5,079,684 | A | 1/1992 | Lai | |
| 5,664,872 | A | 9/1997 | Spearman et al. | |
| 6,095,671 | A | 8/2000 | Hutain | |
| 6,682,303 | B2 | 1/2004 | Wu | |
| 6,966,678 | B2 | 11/2005 | Hsieh | |
| 7,144,135 | B2 | 12/2006 | Martin et al. | |
| 8,087,803 | B2 * | 1/2012 | Zheng | 362/294 |
| 2008/0165535 | A1 * | 7/2008 | Mazzochette | 362/294 |
| 2010/0264826 | A1 * | 10/2010 | Yatsuda et al. | 362/373 |

FOREIGN PATENT DOCUMENTS

| | | |
|---|---|---|
| CN | 2411415 Y | 12/2000 |
| CN | 201246718 Y | 5/2009 |
| JP | 1-159323 | 11/1989 |
| JP | 2-134612 | 11/1990 |
| JP | 3034454 | 2/1997 |
| JP | 2000-133002 | 5/2000 |
| JP | 2004-265626 | 9/2004 |
| JP | 2008198478 | 8/2008 |
| JP | 2010-153198 | 7/2010 |
| TW | 359644 | 6/2009 |

* cited by examiner

*Primary Examiner* — William Carter
(74) *Attorney, Agent, or Firm* — Muncy, Geissler, Olds & Lowe, PLLC

(57) ABSTRACT

A lamp comprises a housing, an inner shell, a fan, a heat sink and a lighting module. The housing has a first compartment and a first opening on an end thereof. The inner shell is adapted to be received in the first compartment and has a second compartment and a second opening on an end thereof, wherein the second opening is aligned with the first opening. An air channel is formed between the housing and the inner shell in the first compartment. The inner shell further comprises a through-hole allowing the first compartment to communicate with the second compartment. The fan is located adjacent to the through-hole and has two air-flowing sides for drawing air in and out of the lamp. The heat sink has a bottom plate with one face facing the fan. The lighting module is adapted to be coupled to another face of the bottom plate.

8 Claims, 8 Drawing Sheets

LAMP WITH AIR CHANNEL

BACKGROUND OF THE INVENTION

1. Field of the Invention

The present invention generally relates to a lamp and, more particularly, to a lamp that is inserted into a ceiling for indoor or outdoor illumination.

2. Description of the Related Art

Taiwan Patent Publication No. M359644 discloses a lamp cooling apparatus comprising a base plate, an annular cooling seat, a fan and a housing. The base plate has a first face and a second face. The first face is mounted with a plurality of light-radiating elements and the second face is coupled with the annular cooling seat, with a plurality of vents extending from the first face to the second face. The fan is disposed on the annular cooling seat. The housing is coupled to the second face of the base plate in order for the annular cooling seat and the fan to be covered in the housing, wherein the first face that is mounted with the light-radiating elements faces outward. The housing has a plurality of stripped vents which allows external air to be drawn into the housing therethrough during rotation of the fan. The drawn-in air flows through the annular cooling seat for air exchange with the heat air generated by the light-radiating elements, and is then drawn out of the lamp via the vents of the base plate.

An embedded lamp refers to as a lamp that is inserted into a "plate ceiling" (means the ceiling that is assembled by a plurality of square plates) by inserting its housing into the ceiling so that the first face of the base plate mounted with the light-radiating elements faces downward for light radiation. In the situation, since the housing has been inserted into the plate ceiling, vents of the housing are located above the plate ceiling. However, the area above the plate ceiling is an enclosed space with poor air circulation, poor heat dissipation is therefore resulted. Furthermore, objects such as pipelines, cable lines or heat shield articles may be disposed in the enclosed area. Therefore, air circulation is further impacted.

As stated above, the conventional lamp has poor heat dissipation due to the structure design thereof, leading to a difficulty in dispelling the heat remained on the annular cooling seat. As a result, the service life of the lamp is reduced as the light-radiating elements have been long operated under a high temperature condition. Furthermore, the luminance of the light-radiating elements is also attenuated when the light-radiating elements are over-temperature.

Therefore, it is desired to improve the conventional lamp.

SUMMARY OF THE INVENTION

It is therefore the primary objective of the invention to provide a lamp with better cooling effect.

It is another objective of the invention to provide a lamp with longer service life.

It is still another objective of the invention to provide a lamp with a consistent level of luminance.

The invention discloses a lamp comprising a housing, an inner shell, a fan, a heat sink and a lighting module. The housing has a first compartment and a first opening on an end thereof. The inner shell is adapted to be received in the first compartment and has a second compartment and a second opening on an end thereof, wherein the second opening is aligned with the first opening. An air channel is formed between the housing and the inner shell in the first compartment. The inner shell further comprises a through-hole allowing the first compartment to communicate with the second compartment. The fan is located adjacent to the through-hole and has two air-flowing sides for drawing air in and out of the lamp such that the air is allowed to pass through the through-hole. The heat sink has a bottom plate with one face facing the fan. The lighting module is adapted to be coupled to another face of the bottom plate.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

Figure 1:
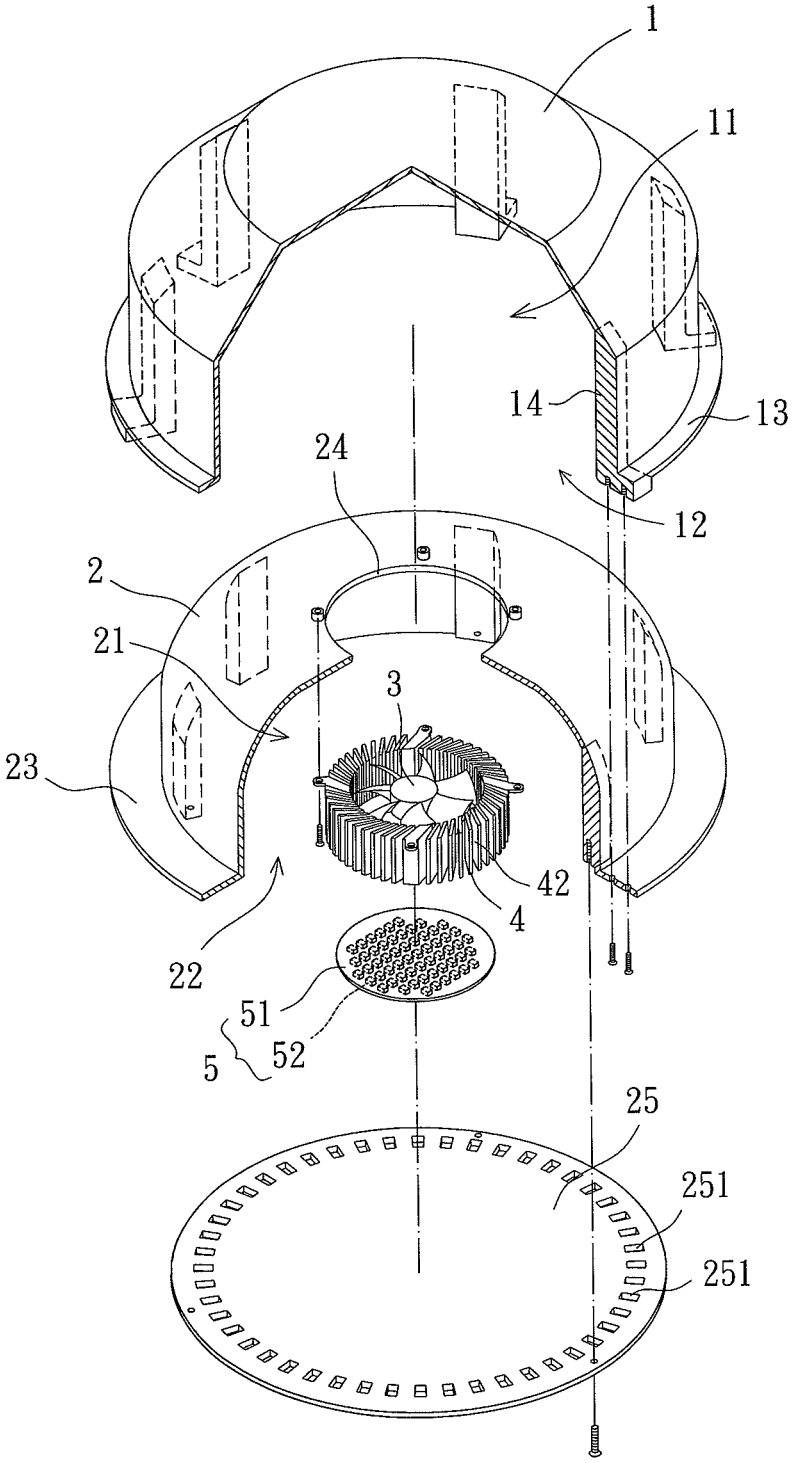
FIG. 1 shows an exploded diagram of a lamp according to a first embodiment of the invention.

In the various figures of the drawings, the same numerals designate the same or similar parts. Furthermore, when the term "first", "second", "third", "fourth", "inner", "outer" "top", "bottom" and similar terms are used hereinafter, it should be understood that these terms are reference only to the structure shown in the drawings as it would appear to a person viewing the drawings and are utilized only to facilitate describing the invention.

DETAILED DESCRIPTION OF THE INVENTION

Figure 2:
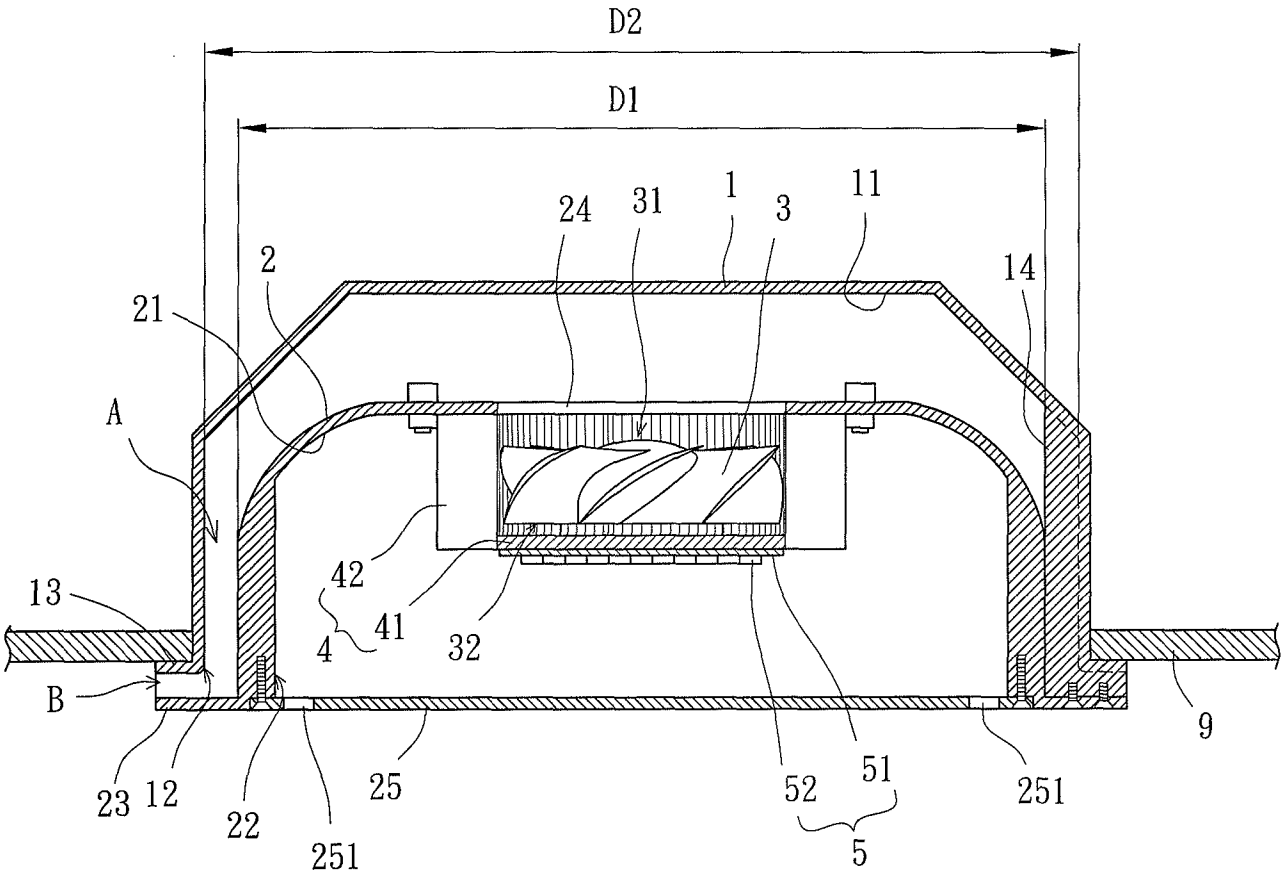
FIG. 2 shows a side cross sectional view of the lamp according to the first embodiment of the invention.

Referring to FIGS. 1 and 2, a lamp is disclosed according to a first embodiment of the invention. The lamp comprises a housing 1, an inner shell 2, a fan 3, a heat sink 4 and a lighting module 5. The inner shell 2 is to be received in the housing 1. An air channel A is formed between the housing 1 and the inner shell 2 when the inner shell 2 is received in the housing 1. The fan 3 is located adjacent to a through-hole 24 of the inner shell 2. The heat sink 4 and lighting module 5 are located inside the inner shell 2. During rotation of the fan 3, air can flow in and out of the inner shell 2 through the through-hole 24 in order to have an air exchange with the heat air generated by the lighting module 5. Thus, cooling of the lighting module 5 is achieved.

The housing 1 comprises a first compartment 11 and a first opening 12 on an end thereof. The housing 1 further comprises a first protrusion 13 which extends outward from a periphery of the first opening 12.

The inner shell 2 has a second compartment 21 and a second opening 22 on an end thereof. The inner shell 2 further comprises a second protrusion 23 which extends outward from a periphery of the second opening 22. A diameter D1 of the inner shell 2 is preferably smaller than a diameter D2 of the first compartment 11. The second opening 22 preferably has the same shape as the first opening 12. In addition, the second opening 22 preferably has a diameter smaller than that of the first opening 12 such that the second opening 22 is covered in the range of the first opening 12 when the inner shell 2 is received in the first compartment 11. The through-hole 24 extends from an outer surface of the inner shell 2 to an inner surface of the inner shell 2 so that the first compartment 11 is allowed to communicate with the second compartment 21.

A separation member 14 is disposed between the housing 1 and the inner shell 2, which may be in a stick-like, column-like, block-like or strip-like form, such as ribs, pillars or blocks and so on. The separation member 14 may be disposed on an inner surface of the housing 1 or an outer surface of the inner shell 2 so as to space the housing 1 from the inner shell 2. In the embodiment, the separation member 14 is in form of a plurality of ribs disposed on the outer surface of the inner shell 2.

The fan 3 may guide the air through the through-hole 24 and has two air-flowing sides, namely, an air inlet 31 and an air outlet 32.

The heat sink 4 is preferably made of a material with high heat conductivity. The heat sink 4 comprises a bottom plate 41 having one face mounted with a plurality of fins 42.

The lighting module 5 comprises a base plate 51 and a plurality of lighting elements 52. The lighting elements 52 may preferably be light-emitting diodes (LEDs) mounted on one face of the base plate 51.

Referring to FIGS. 1 and 2 again, during assembly of the lamp, the second opening 22 is aligned with the first opening 12 and covered in the range of the first opening 12 when the inner shell 2 is received in the first compartment 11. The housing 1 is spaced from the inner shell 2 by the ribs so that the air channel A between the housing 1 and the inner shell 2 is formed. In addition, a ventilation opening B may be formed between the first protrusion 13 and the second protrusion 23 via the separation members 14 separating the housing 1 from the inner shell 2, thereby allowing the external air to flow into the air channel A via the ventilation opening B.

The fan 3 may be disposed adjacent to or in the through-hole 24, with one air-flowing side thereof communicating with the air channel A and another air-flowing side thereof communicating with the second compartment 21 to allow air flow between the air channel A and the second compartment 21. In the embodiment, the fan 3 is disposed in a location adjacent to the through-hole 24 in the second compartment 21, with the air inlet 31 communicating with the air channel A and the air outlet 32 communicating with the second compartment 21. In this way, external air is drawn into the lamp via the ventilation opening B and flows into the second compartment 21 via the air channel A and the through-hole 24.

The heat sink 4 is disposed in the second compartment 21, with the face of the bottom plate 41 mounted with the fins 42 preferably facing the air outlet 32. The fins 42 may be evenly spaced on the bottom plate 41. Alternatively, as shown in the embodiment, the fins 42 may be disposed along a periphery of the bottom plate 41 so as to form a circular space for receiving the fan 3.

The base plate 51 of the lighting module 5 is coupled to another face of the bottom plate 41 not mounted with the fins 42, with the lighting elements 52 facing the second opening 22. A covering plate 25 may be further disposed on the second opening 22. The covering plate 25 is preferably a light-permeable plate that allows passage of lights, such as a transparent or translucent plate. The covering plate 25 has a plurality of vents 251 preferably located along a periphery thereof.

Referring to FIG. 2, when in use, the housing 1 is inserted into a ceiling 9, with the first protrusion 13 of the housing 1 abutting upward with the ceiling 9. When the fan 3 rotates, the air can flow between the air channel A and the second compartment 21 via the through-hole 24, enabling the air to flow through the heat sink 4 for dispelling the heat air generated by the lighting module 5. The direction of air flow may be changed by switching the rotation directions of the fan 3. For example, when the fan 3 rotates in a clockwise direction, the external air is drawn into the second compartment 21 via the ventilation opening B, air channel A and through-hole 24, and then drawn out of the lamp via the vents 251. On the contrary, when the fan 3 rotates in a countclockwise direction, the external air is drawn into the second compartment 21 via the vents 251, and then drawn out of the lamp via through-hole 24, air channel A and ventilation opening B. Thus, the heat generated by the lighting module 5 is dispelled.

Despite the rotation direction of the fan 3, since the ventilation opening B and the vents 251 are both located beneath the ceiling 9 rather than above the ceiling 9, the ventilation opening B and the vents 251 are allowed to communicate with the external air. Thus, the air inside the lamp is allowed to have a smooth circulation with the external air. Besides, since the ventilation opening B is separated from the vents 251 by the second protrusion 23, it is avoided that the exhausted heat air be immediately drawn into the lamp again. Thus, better ventilation and cooling effects of the lamp are provided.

Figure 3:
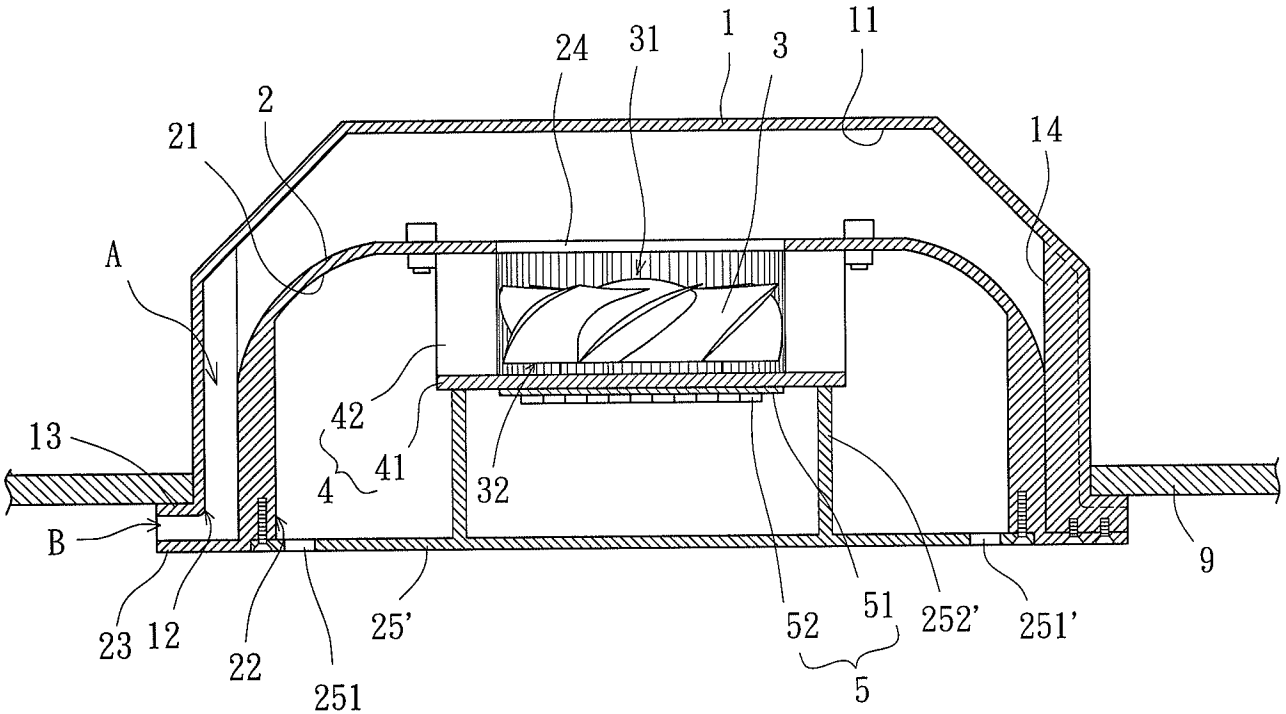
FIG. 3 shows a side cross sectional view of a lamp according to a second embodiment of the invention.

Referring to FIG. 3, a lamp is disclosed according to a second embodiment of the invention. The lamp comprises a housing 1, an inner shell 2, a fan 3, a heat sink 4 and a lighting module 5. A covering plate 25' is also disposed on the second opening 22 of the inner shell 2.

In contrast to the previous first embodiment, a separation portion 252' is disposed on one face of the covering plate 25' facing the lighting module 5. The separation portion 252' is preferably in form of an annular lateral wall, with a plurality of vents 251' being located out of an encompassed range of the separation portion 252'. In addition, when the covering plate 25' is assembled in the second opening 22 of the inner shell 2, a top side of the separation portion 252' is in contact with the bottom plate 41 of the heat sink 4, allowing the lighting module 5 to be located inside the encompassed range of the separation portion 252'.

Based on this, when the fan 3 rotates in a direction, external air is drawn into the lamp via the ventilation opening B and the air channel A, then flows through the through-hole 24 and the heat sink 4 and is finally drawn out of the lamp via the vents 251' of the covering plate 25'. On the contrary, when the fan 3 rotates in another direction, external air is drawn into the lamp via the vents 251' of the covering plate 25', then flows through the heat sink 4 and the through-hole 24 and is finally drawn out of the lamp via the ventilation opening B.

Despite the rotation directions of the fan 3, the lighting elements 52 or circuit chip of the lighting module 5 is separated from the external air by the separation portion 252', thus avoiding accumulation of dust inside the lamp.

Figure 4:
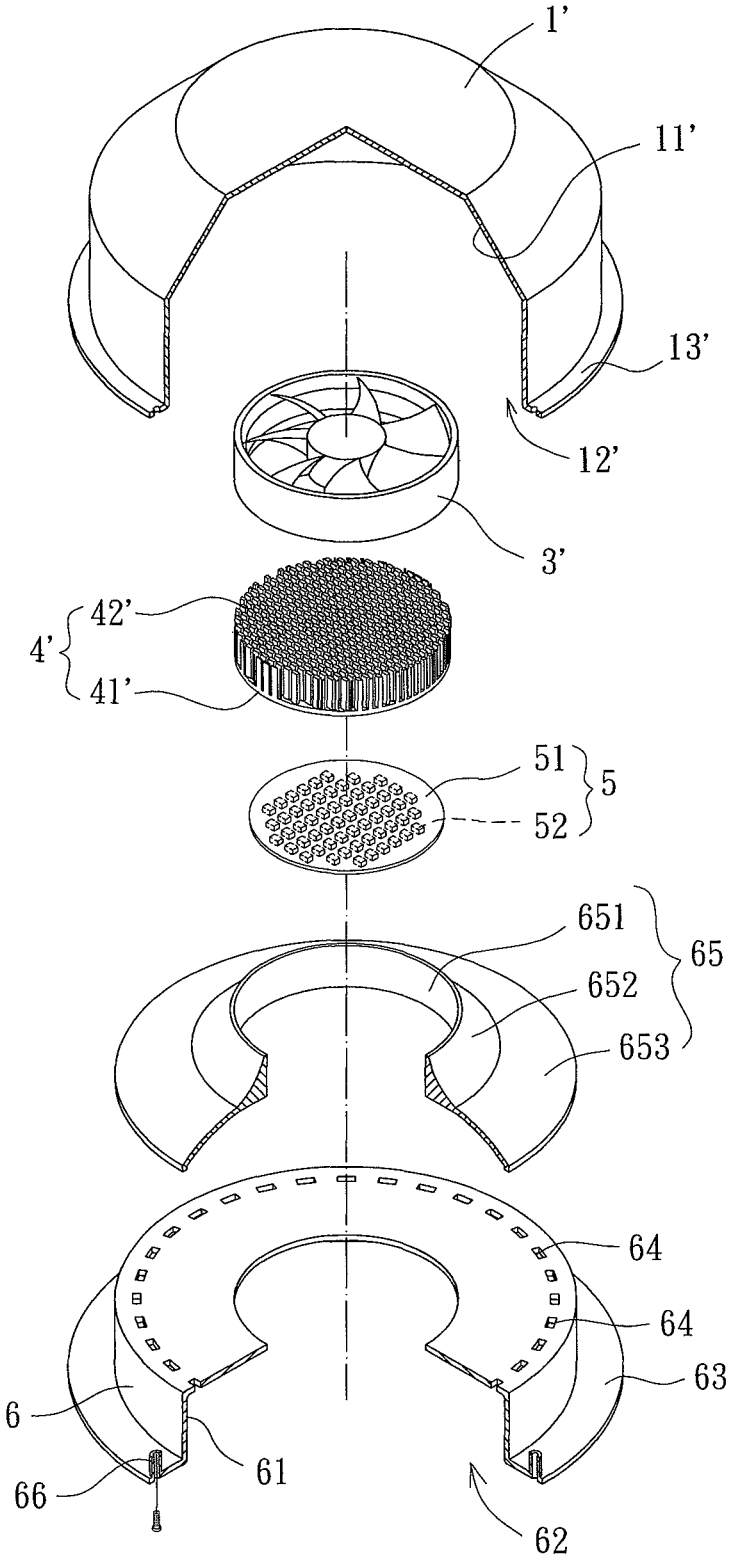
FIG. 4 shows an exploded diagram of a lamp according to a third embodiment of the invention.

Referring to FIG. 4, a lamp is disclosed according to a third embodiment of the invention. The lamp comprises a housing 1', an inner shell 6, a fan 3', a heat sink 4' and a lighting module 5'.

In contrast to the previous embodiment, the inner shell 6 has a second compartment 61 and a plurality of vents 64. The fan 3' is preferably located adjacent to and surrounded by the vents 64 such that the air can flow between the air channel A and the second compartment 61 via the vents 64. The inner shell 6 further comprises an air-guiding cap 65 in form of a plate. The air-guiding cap 65 has an assembly hole 651, an annular portion 652 and an extension portion 653. The assembly hole 651 is located on a center of the air-guiding cap 65 for receiving the fan 3'. The annular portion 652 extends outward and downward in a curved manner from an outer periphery thereof to form the extension portion 653, so as to facilitate the air flows of the lamp. An outer periphery of the extension portion 653 is coupled to the inner shell 6 during assembly. The vents 64 are covered under the air-guiding cap 65 when the air-guiding cap 65 is coupled to the inner shell 6.

A plurality of supporting columns 66 is disposed between the housing 1' and the inner shell 6. Specifically, the supporting columns 66 are disposed on a second protrusion 63 of the inner shell 6 and abut upward with a first protrusion 13' of the housing 1'. Thus, the housing 1' is spaced from the inner shell 6 by the supporting columns 66.

Figure 5:
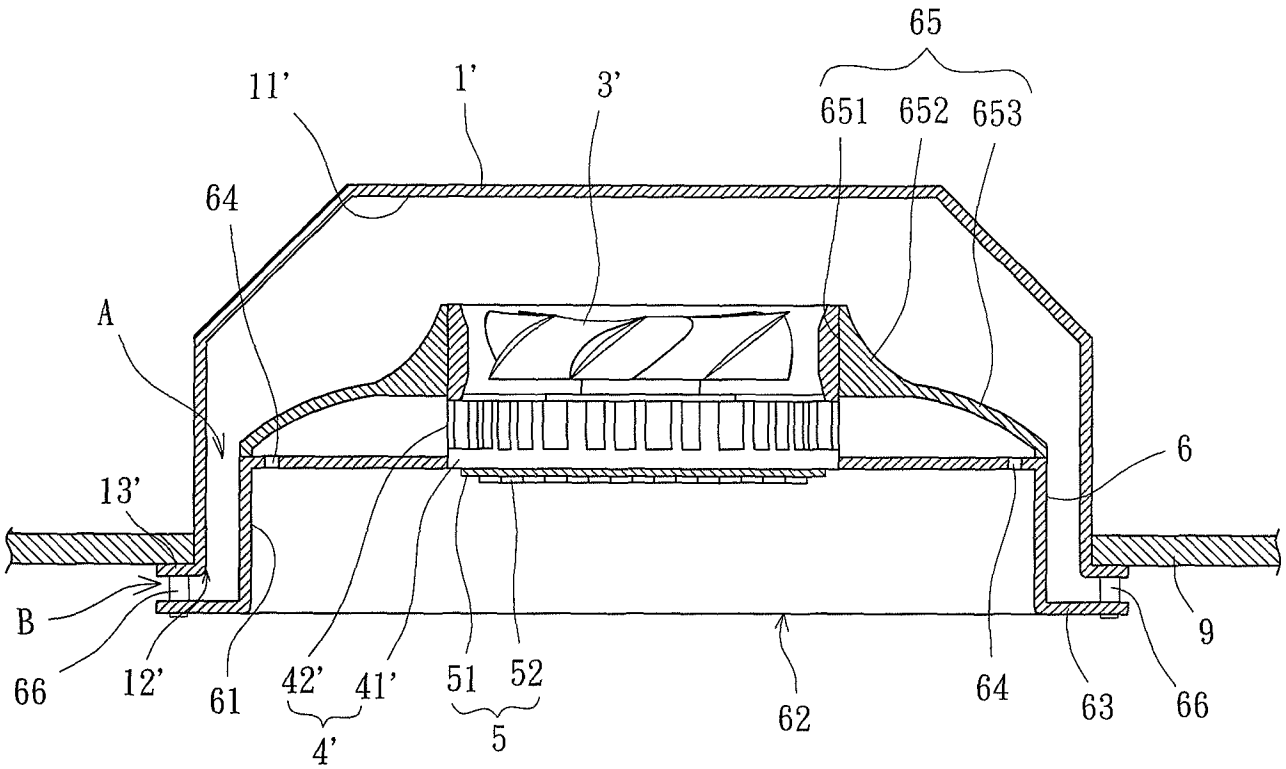
FIG. 5 shows a side cross sectional view of the lamp according to the third embodiment of the invention.

Referring to FIGS. 4 and 5, during assembly of the lamp, the second opening 22 is aligned with a first opening 12' of the housing 1' and covered in the range of the first opening 12' when the inner shell 6 is received in a first compartment 11'. An air channel A is formed by the supporting columns 66 spacing the housing 1' from the inner shell 6. A ventilation opening B is formed between the second protrusion 63 and the first protrusion 13'.

Referring to FIG. 5, the fan 3' is disposed in the air-guiding cap 65 and the heat sink 4' is disposed on the inner shell 6. The heat sink 4' comprises a bottom plate 41' having one face mounted with a plurality of fins 42', with the face mounted with the fins 42' preferably facing the fan 3'. The base plate 51 of the lighting module 5 is coupled to another face of the bottom plate 41' not mounted with the fins 42', with the lighting elements 52 facing a second opening 62 of the inner shell 6.

Referring to FIG. 5, when in use, the housing 1' is inserted into the ceiling 9, with the first protrusion 13' of the housing 1' abutting upward with the ceiling 9. When the fan 3' rotates, the air can flow between the air channel A and the second compartment 61 via the vents 64, enabling the air to flow through the heat sink 4' for dispelling the heat air generated by the lighting module 5. Therefore, the third embodiment facilitates not only the ventilation but also the cooling of the lamp.

Figure 6:
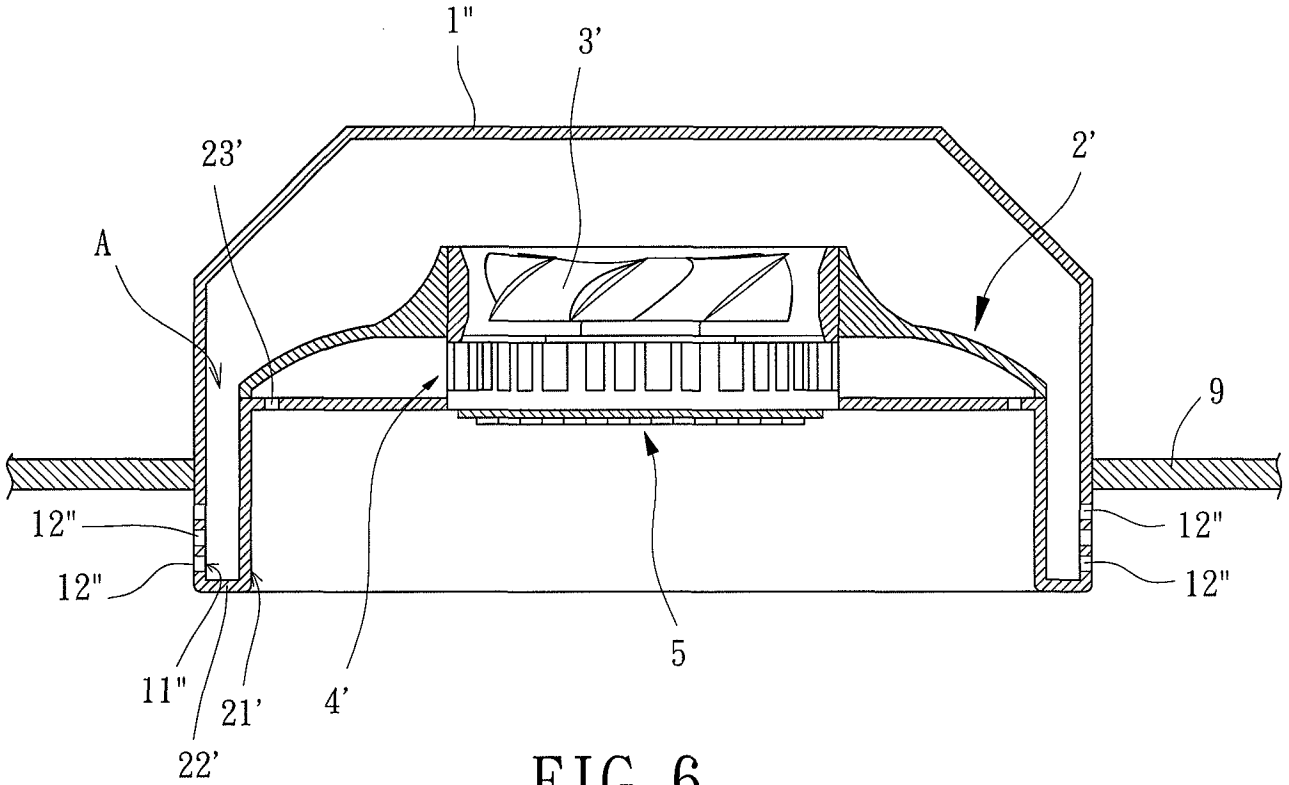
FIG. 6 shows a side cross sectional view of a lamp according to a fourth embodiment of the invention.

Referring to FIG. 6, a lamp is disclosed according to a fourth embodiment of the invention. The lamp comprises a housing 1", an inner shell 2', a fan 3', a heat sink 4' and a lighting module 5. In contrast to the previous three embodiments, the inner shell 2' has a second compartment 21' extending outward to form a second protrusion 22'. An outer periphery of the second protrusion 22' is coupled to a circumference of a first opening 11" of the housing 1" so as to close the first opening 11". An air channel A is also formed between the housing 1" and the inner shell 2'. The housing 1" has a plurality of vents 12" which is adjacent to the first opening 11" and located on an outer surface thereof.

When in use, the housing 1" is inserted into the ceiling 9 in a way that the vents 12" are allowed to communicate with the outside air beneath the ceiling 9. When the fan 3' rotates, the air can be drawn into the lamp via the vents 12" and the air channel A, enabling the air to flow through the heat sink 4' for dispelling the heat air generated by the lighting module 5 and then to be drawn out of the lamp via vents 23'. In the embodiment, because the first opening 11" is closed by the second protrusion 22', the lamp has a better visual effect.

Figure 7:
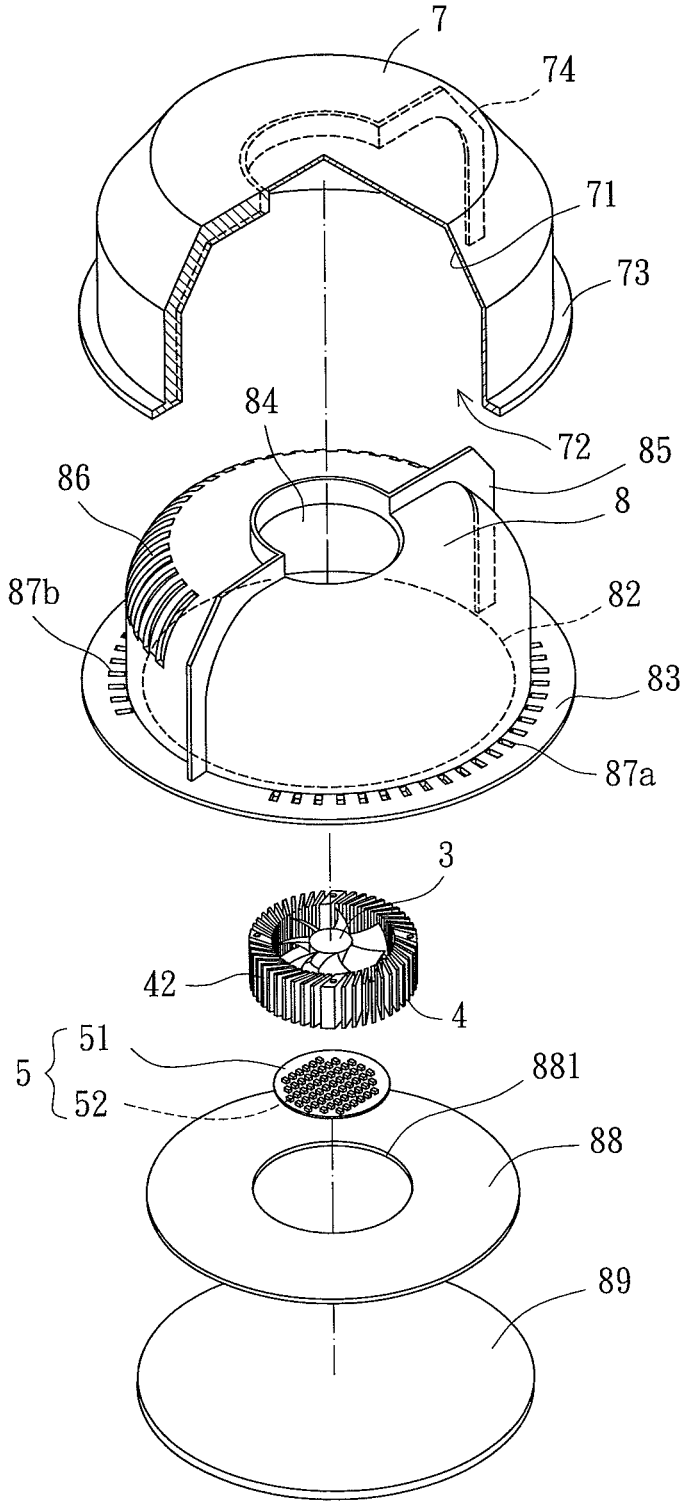
FIG. 7 shows an exploded diagram of a lamp according to a fifth embodiment of the invention.
Figure 8:
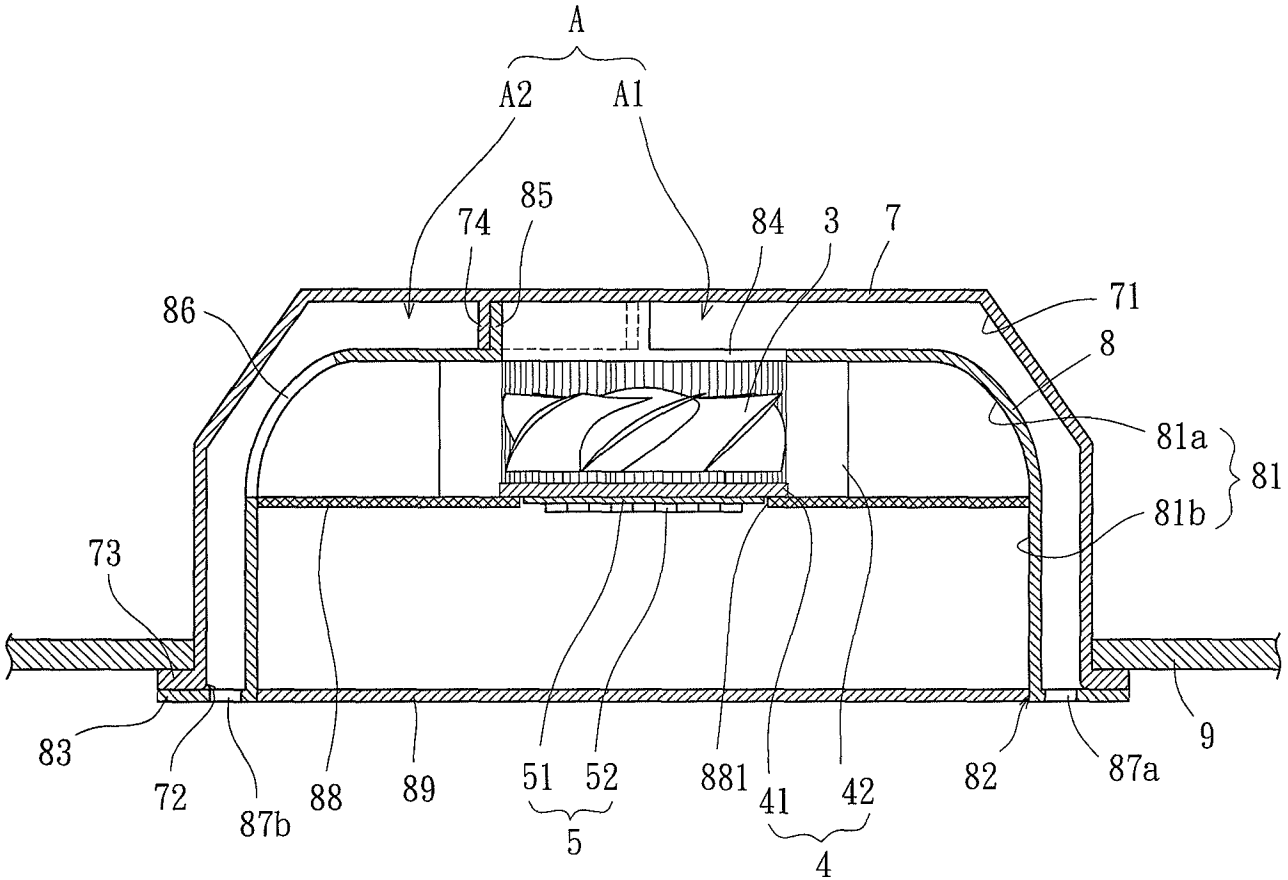
FIG. 8 shows a side cross sectional view of the lamp according to the fifth embodiment of the invention.

Referring to FIGS. 7 and 8, a lamp is disclosed according to a fifth embodiment of the invention. The lamp comprises a housing 7, an inner shell 8, a fan 3, a heat sink 4 and a lighting module 5. In contrast to the first embodiment, the housing 7 comprises a first protrusion 73 abutting with a second protrusion 83 of the inner shell 8 such that a first opening 72 of the housing 7 is closed by the second protrusion 83.

The housing 7 has a separation member 74 in form of a labyrinth protrusion which is located in a first compartment 71 thereof and abuts with an inner surface thereof. The inner shell 8 has a separation member 85 also in form of a labyrinth protrusion abutting with an outer surface thereof. The housing 7 is spaced from the inner shell 8 via the separation members 74 and 85, thus forming an air channel A.

In the embodiment, the separation members 74 and 85 abut with each other so that the air channel A is separated into a first air channel A1 and a second air channel A2. The inner shell 8 has a through-hole 84 in communication with the first air channel A1. The first air channel A1 communicates with a second compartment 81 of the inner shell 8 via the through-hole 84. The inner shell 8 has a plurality of stripped vents 86 in communication with the second air channel A2 such that the second air channel A2 is allowed to communicate with the second compartment 81 via the stripped vents 86. The second protrusion 83 of the inner shell 8 has a plurality of first vents 87*a* and a plurality of second vents 87*b*, with the first vents 87*a* communicating with the first air channel A1 and the second vents 87*b* communicating with the second air channel A2.

When the fan 3 rotates in a direction, the external air can be drawn into the lamp via the first vents 87*a*, then flows through the first air channel A1, through-hole 84, second compartment 81, stripped vents 86 and second air channel A2, and is finally drawn out of the lamp via second vents 87*b*. Alternatively, when the fan 3 rotates in another direction, the external air can be drawn into the lamp via the second vents 87*b*, then flows through the second air channel A2, stripped vents 86, second compartment 81, through-hole 84 and first air channel A1, and is finally drawn out of the lamp via first vents 87*a*. Thus, heat generated by the lighting module 5 is dispelled.

The first vents 87*a* and second vents 87*b* may be selectively located on an outer surface of the housing 7 adjacent to the first opening 72, with the first vents 87*a* communicating with the first air channel A1 and the second vents 87*b* communicating with the second air channel A2. In this way, the external air can flow in and out of the lamp through the same paths described above.

A separation plate 88 may be further disposed in the second compartment 81 of the inner shell 8 so as to separate the second compartment 81 into an upper compartment 81*a* and a lower compartment 81*b*, with the through-hole 84 and the stripped vents 86 communicating with the upper compartment 81*a*. The separation plate 88 has an assembly hole 881, with the lighting elements 52 of the lighting module 5 preferably disposed in the assembly hole 881 and facing the lower compartment 81*b*. A covering plate 89 may be disposed in the second opening 82 of the inner shell 8, with the covering plate 89 being preferably made of a light-permeable material such as a transparent or translucent plate. With the covering plate 89, the lighting elements 52 or circuit chip of the lighting module 5 is separated from external air, avoiding accumulation of dust inside the lamp.

As stated above, the air channel and the vents of the lamp are allowed to communicate with the outside air beneath the ceiling when the housing of the lamp is inserted into the ceiling, thus allowing the external air to enter the lamp for air circulation. In this way, heat dissipation of the lamp is increased.

The invention facilitates heat dissipation of a lighting module of a lamp by providing the lamp with better air circulation and cooling effect, thereby prolonging the service life of the lamp.

The invention facilitates heat dissipation of a lighting module of a lamp so that the luminance attenuation of the lighting module resulted from a high temperature operation is avoided.

Although the invention has been described in detail with reference to its presently preferable embodiment, it will be understood by one of ordinary skill in the art that various modifications can be made without departing from the spirit and the scope of the invention, as set forth in the appended claims.

What is claimed is:

1. A lamp, comprising:

a housing having a first compartment, and a first opening on an end thereof and a first protrusion extending outward from a periphery of the first opening;

an inner shell adapted to be received in the first compartment and having a second compartment and a second opening on an end thereof, and a second protrusion extending outward from a periphery of the second opening, wherein the first protrusion abuts with the second protrusion such that the first opening is closed by the second protrusion, a separation member abutting against the housing and the inner shell so as to form an air channel between the housing and the inner shell in the first compartment, wherein the separation member is in form of a labyrinth protrusion adapted to separate the air channel into a first air channel and a second air channel, the inner shell further comprises a through-hole allowing the first compartment to communicate with the second compartment;

a fan located adjacent to the through-hole and having two air-flowing sides for drawing air in and out of the lamp such that the air is allowed to pass through the through-hole;

a heat sink having a bottom plate with one face facing the fan; and a lighting module adapted to be coupled to another face of the bottom plate.

2. The lamp as claimed in claim 1, wherein the through-hole is adapted for the first air channel to communicate with the second compartment, and the inner shell further comprises a plurality of stripped vents allowing the second air channel to communicate with the second compartment.

3. The lamp as claimed in claim 2, wherein the second protrusion has a plurality of first vents and a plurality of second vents, with the first vents communicating with the first air channel and the second vents communicating with the second air channel.

4. The lamp as claimed in claim 3, further comprising a separation plate disposed in the second compartment adapted to separate the second compartment into an upper compartment and a lower compartment, with the through-hole and the stripped vents communicating with the upper compartment.

5. The lamp as claimed in claim 4, wherein the separation plate has an assembly hole, wherein the lighting module is disposed in the assembly hole and faces the lower compartment.

6. The lamp as claimed in claim 5, further comprising a covering plate disposed in the second opening.

7. A lamp, comprising:

a housing having a first compartment and a first opening on an end thereof;

an inner shell adapted to be received in the first compartment and having a second compartment and a second opening on an end thereof, wherein the second opening is aligned with the first opening, an air channel is formed between the housing and the inner shell in the first compartment, the inner shell further comprises a through-hole allowing the first compartment to communicate with the second compartment;

a fan located adjacent to the through-hole and having two air-flowing sides for drawing air in and out of the lamp such that the air is allowed to pass through the through-hole;

a heat sink having a bottom plate with one face facing the fan; and a lighting module adapted to be coupled to another face of the bottom plate; wherein a covering plate disposed on the second opening, and the covering plate has a plurality of vents, and a separation portion disposes on one face of the covering plate facing the lighting module, the vents are located out of an encompassed range of the separation portion, the separation portion is in contact with the bottom plate of the heat sink, and the lighting module is located inside the encompassed range of the separation portion.

8. The lamp as claimed in claim 7, wherein the separation portion comprises an annular lateral wall.

* * * * *